US009989306B2

(12) United States Patent
Lautenschlager

(10) Patent No.: US 9,989,306 B2
(45) Date of Patent: Jun. 5, 2018

(54) METHOD AND DEVICE FOR RECOVERING HIGH-PRESSURE OXYGEN AND HIGH-PRESSURE NITROGEN

(71) Applicant: LINDE AKTIENGESELLSCHAFT, Munich (DE)

(72) Inventor: Tobias Lautenschlager, Grobenzell (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 15 days.

(21) Appl. No.: 14/184,906

(22) Filed: Feb. 20, 2014

(65) Prior Publication Data

US 2014/0230486 A1 Aug. 21, 2014

(30) Foreign Application Priority Data

Feb. 21, 2013 (EP) ..... 13000875

(51) Int. Cl.
*F25J 3/04* (2006.01)

(52) U.S. Cl.
CPC ..... *F25J 3/04084* (2013.01); *F25J 3/0409* (2013.01); *F25J 3/04218* (2013.01); (Continued)

(58) Field of Classification Search
CPC ..... F25J 3/04218–3/04224
See application file for complete search history.

(56) References Cited

U.S. PATENT DOCUMENTS 5,355,682 A * 10/1994 Agrawal ..... F25J 3/04084 62/646
5,901,577 A 5/1999 Pelle et al.
(Continued)

FOREIGN PATENT DOCUMENTS

CA 2295453 A1 * 8/2000 ..... F25J 3/04084
DE 3216510 A1 11/1983
(Continued)

OTHER PUBLICATIONS

Search Report dated Sep. 20, 2013 issued in corresponding EP 13000875 application (pp. 1-2).
(Continued)

*Primary Examiner* — Tareq Alosh
(74) *Attorney, Agent, or Firm* — Millen, White, Zelano, Branigan, P.C.

(57) ABSTRACT

The method and device according to the invention provide for recovery of high-pressure oxygen and high-pressure nitrogen by low-temperature separation of air in a distillation-column system. This system comprises a high-pressure column, a low-pressure column, and a main condenser. A first air feed stream is cooled at a first subcritical pressure in a main heat exchanger to approximately dew point and introduced at least partially into the high-pressure column. A second air feed stream is brought to a second, supercritical, pressure, cooled, depressurized, and introduced at least partially into the distillation-column system. A first partial stream of the second air feed stream is cooled in the main heat exchanger, and a second partial stream is cooled in a high-pressure heat-exchanger system. The first and second partial streams are then merged and work-expanded in a liquid turbine.

20 Claims, 1 Drawing Sheet

(52) U.S. Cl.
CPC ..... *F25J 3/04296* (2013.01); *F25J 3/04387* (2013.01); *F25J 3/04412* (2013.01); *F25J 2240/10* (2013.01)

(56) References Cited

U.S. PATENT DOCUMENTS

| | | | | |
|---|---|---|---|---|
| 2003/0140654 | A1* | 7/2003 | Briglia | F25J 3/0409 62/654 |
| 2008/0307828 | A1* | 12/2008 | Prosser | F25J 3/04084 62/644 |
| 2009/0120128 | A1* | 5/2009 | Lochner | F25J 3/04048 62/643 |
| 2011/0192194 | A1* | 8/2011 | Howard | F25J 3/04084 62/644 |

FOREIGN PATENT DOCUMENTS

| | | | |
|---|---|---|---|
| EP | 0869322 | A1 | 10/1998 |
| WO | 2012/155318 | A1 | 11/2012 |

OTHER PUBLICATIONS

"Method for High Pressure Oxygen Production", Research Disclosure, Mason Publications, No. 450 (Oct. 1, 2001) pp. 1676-1678.
W.F. Castle "Modern Liquid Pump Oxygen Plants: Equipment and Performance", Aiche Intersociety Cryogenic Symposium, vol. 89 No. 294 (Apr. 1, 1991) pp. 14-17.
R.E. Latimer "Distillation of Air", Chemical Engineering Progress, vol. 63 No. 2 (Feb. 1967) pp. 35-58.
"Tieftemperaturtechnik [Low-Temperature Technology]", Hausen/Linde (2nd Edition, 1985) pp. 470-475.

* cited by examiner

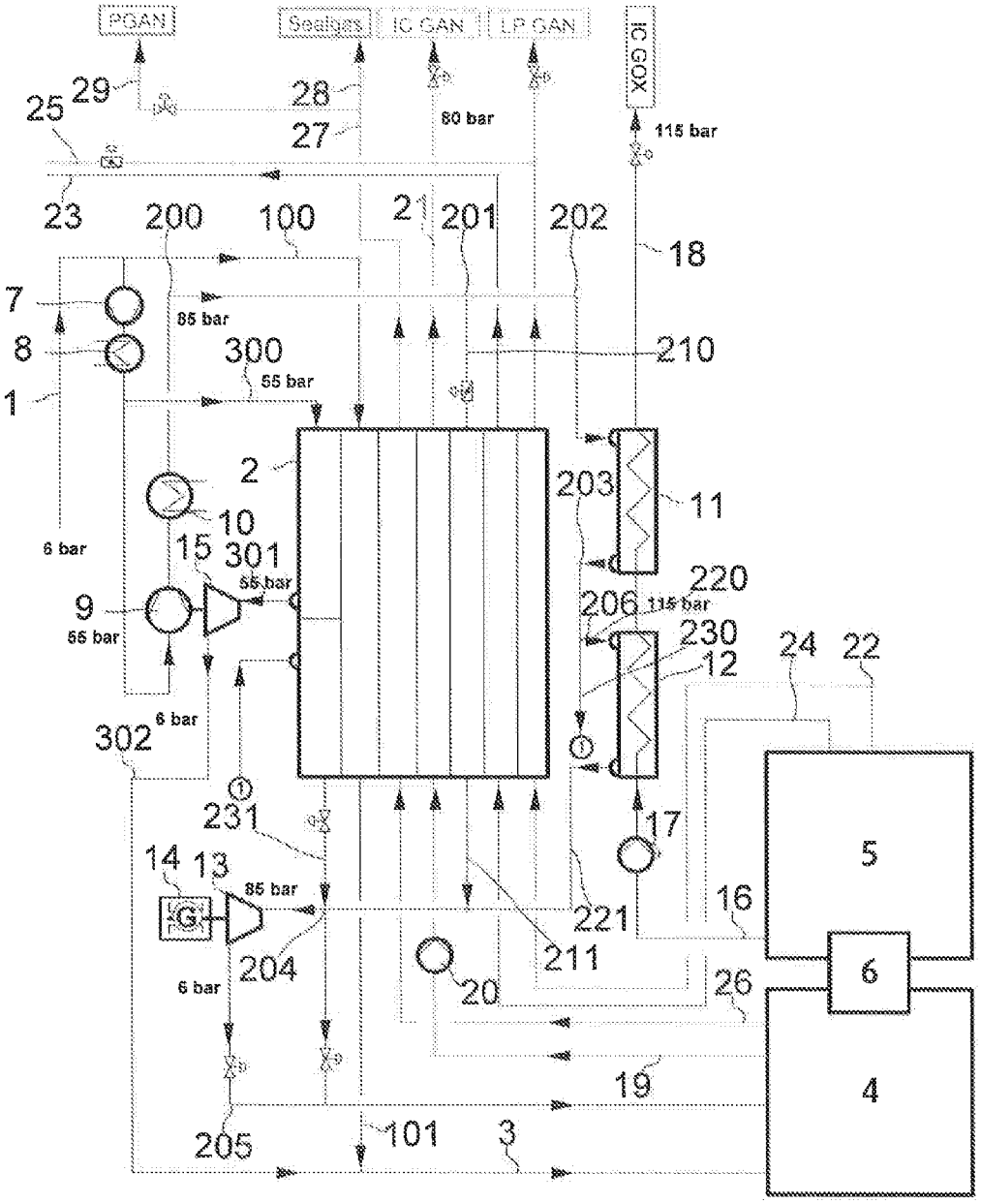
PGAN
Sealgas
IC GAN
LP GAN
IC GOX
29
28
27
25
80 bar
115 bar
23
200
100
21
201
202
18
7
85 bar
8
300
210
55 bar
1
2
203
11
10
6 bar
15
301
55 bar
220
9
206
115 bar
230
55 bar
12
24
22
6 bar
302
231
17
14
13
85 bar
5
221
16
204
211
6 bar
20
26
6
19
4
205
101
3

METHOD AND DEVICE FOR RECOVERING HIGH-PRESSURE OXYGEN AND HIGH-PRESSURE NITROGEN

In general, the invention relates to a method for recovering high-pressure oxygen and high-pressure nitrogen by low-temperature separation of air in a distillation-column system having a high-pressure column and a low-pressure column that are in heat-exchanging connection via a condenser-evaporator. In the method, a first air feed stream at a first, subcritical, pressure, which is less than 1 bar above the operating pressure of the high-pressure column, is cooled in a main heat exchanger to approximately its dew point, and is then introduced at least partially into the high-pressure column. A second air feed stream at a second, supercritical, pressure, is cooled then depressurized and introduced at least partially into the distillation-column system.

A liquid oxygen stream removed from the low-pressure column is brought in the liquid state to a first product pressure, which is higher than the operating pressure of the low-pressure column. This liquid oxygen stream is heated to approximately ambient temperature in a high-pressure heat-exchanger system, which has at least one helically-wound heat exchanger, and ultimately is recovered as a high-pressure oxygen product stream.

A liquid nitrogen stream removed from the high-pressure column or from the condenser-evaporator is brought in the liquid state to a second product pressure, which is higher than the operating pressure of the high-pressure column. This liquid nitrogen stream is to approximately ambient temperature, and ultimately is recovered as a high-pressure nitrogen product stream.

The cooling of a first partial stream of the second air stream is performed by indirect heat exchange outside of the high-pressure heat-exchanger system, and the cooling of a second partial stream of the second air feed stream is performed in the high-pressure heat-exchanger system. The first and second partial streams of the second air feed stream are then merged downstream from their cooling.

The principles of low-temperature separation of air in general as well as the design of two-column units in special cases are described in the monography "Tieftemperaturtechnik [Low-Temperature Technology]" of Hausen/Linde ($2^{nd}$ Edition, 1985) and in an article by Latimer in Chemical Engineering Progress (Vol. 63, No. 2, 1967, page 35). As a rule, the heat-exchange relationship between the high-pressure column and the low-pressure column of a double column is achieved by a main condenser, in which overhead gas from the high-pressure column is liquefied against evaporating bottom liquid from the low-pressure column. The distillation-column system of the invention can be designed as a standard double-column system but also as a three-column or multiple-column system. In addition to the columns for nitrogen-oxygen separation, the distillation-column system can include additional devices for recovering other air components, in particular noble gases, for example, an argon recovery device.

The main condenser is realized as a condenser-evaporator. A "condenser-evaporator" is a heat exchanger in which a first, condensing fluid stream enters into indirect heat exchange with a second, evaporating fluid stream. Each condenser-evaporator has a liquefaction chamber and an evaporation chamber, which contain, respectively, liquefaction passages and evaporation passages. In the liquefaction chamber, the condensation (liquefaction) of a first fluid stream is performed; in the evaporation chamber, the evaporation of a second fluid stream is performed. The evaporation and liquefaction chambers are each formed by groups of passages that are arranged below one another in a heat-exchange relationship.

The "main heat exchanger" serves to cool feed air at a first, subcritical, pressure, which is less than 1 bar above the operating pressure of the high-pressure column, by indirect heat exchange with process fluids from the distillation-column system. It can be formed from an individual heat-exchanger section or several heat-exchanger sections connected in a parallel and/or serial manner, for example, from one or more plate heat-exchanger blocks. If the heat-exchanger sections are connected in parallel, the feed air stream at the first, subcritical, pressure flows through each of them. In the case of a "helically-wound heat exchanger" or "coil-wound heat exchangers," several layers of pipes are wound around a central pipe. A medium is directed through the individual pipes and enters into heat exchange with a medium that flows in the space between the pipes and a surrounding jacket or shell. The pipes are bundled into several groups on the upper heat-exchanger end and directed out from the surrounding jacket or shell in the form of bundles. Such helically-wound heat exchangers, their production and their use are described in, for example, Hausen/Linde, Tieftemperaturtechnik, $2^{nd}$ Edition, 1985, pp. 471-475.

In the process, two liquid product streams are pressurized in liquid form and evaporated against a heat-transfer medium, in particular feed air, especially feed air under high pressure. They are ultimately recovered as a pressurized gaseous product. This method is also referred to as "internal compression," and serves to recover pressurized oxygen and pressurized nitrogen. In the case of product streams under supercritical pressure, no phase transition takes place in the actual sense, and the product streams are then only heated; this is many times also referred to as "pseudo-evaporation."

A method of the above-mentioned type is known from U.S. Pat. No. 5,355,682 (Agrawal et al.).

An object of the invention is to provide such a method and a corresponding device, which have a high efficiency with a simultaneously relatively low cost in terms of equipment and are suitable, in particular, for the supply of oxygen and/or nitrogen to a coal gasification power plant (IGCC—Integrated Gasification Combined Cycle).

Upon further study of the specification and appended claims, other objects, aspects and advantages of the invention will become apparent.

These objects are achieved by modifying a process and system as described above to include: heating a pressurized liquid nitrogen stream in the main heat exchanger; cooling a first partial stream of a second air feed stream in the main heat exchanger; depressurizing a recombined second air feed stream in a liquid turbine before it is introduced into the distribution-column system; using a high-pressure heat-exchanger system that includes two helically-wound heat exchangers connected in series; and/or branching a third partial stream from the second partial stream of the second air feed stream between the two helically-wound heat exchangers and introducing the third partial stream into the main heat exchanger at an intermediate point to further cool the third partial stream therein, while the second partial stream of the second charging air stream is further cooled in the high-pressure heat-exchanger system.

First, it seems more reasonable to run only the low-pressure streams through the main heat exchanger, since such low-pressure streams can then be produced especially economically. However, within the scope of the invention it has turned out, surprisingly enough, that in many cases, it is more advantageous to evaporate or to pseudo-evaporate the high-pressure nitrogen in the main heat exchanger. Preferably, the entire nitrogen stream, which is pressurized in liquid form and which is recovered as a high-pressure nitrogen product stream, is introduced into the main heat exchanger. While the cost of the main heat exchanger is thus admittedly increased the production cost for the correspondingly simpler high-pressure heat-exchanger system is disproportionately lower. This applies even when the increased cost is taken into consideration by the distribution of the second air feed stream.

The joint work-expansion of the two recombined parts of the second air feed stream in a liquid turbine (DLE—dense liquid expander) is used to further increase the energy efficiency of the method. The mechanical energy generated in the liquid turbine can be released either directly to a compressor or converted into electrical energy via a generator.

By contrast, the merging of the two parts of the second charging air stream and/or the liquid turbines can also be eliminated. The two parts are then, for example, depressurized separately or together in one or more choke valves to the pressure of the distillation-column system.

In the invention, a compensating stream (a "third partial stream" of the second air feed stream) is removed at an intermediate temperature from the high-pressure heat-exchanger system and introduced into the main heat exchanger. By means of this measure, both heat-exchange processes can be better optimized and thus operate noticeably more efficiently.

To this end, the high-pressure heat-exchanger system has at least two helically-wound heat exchangers that are connected in series, between which the third partial stream is removed from the high-pressure heat-exchanger system and sent to the main heat exchanger. These two helically-wound heat exchangers, connected in series, can be made up of two heat-exchanger bundles in two separate shells or made up of two heat-exchanger bundles connected in series that are arranged above one another in the same shell.

The intermediate temperature, at which the third partial stream is removed from the high-pressure heat-exchanger system and introduced into the main heat exchanger, generally lies between 220 and 120 K, preferably between 190 and 150 K.

The third partial stream can be run separately from the second partial stream through the high-pressure heat-exchanger system; preferably, however, the third partial stream is run together with the second partial stream through the hotter of the two helically-wound heat exchangers. Of course, the high-pressure heat-exchanger system can also have three or more heat-exchanger bundles.

Preferably, all three partial streams of the second charging air stream are subjected to work-expansion in the liquid turbine. With regards to preferred pressures for certain process streams:

- The first product pressure (pressurized liquid oxygen that is heated in the high-pressure heat-exchanger system) is preferably higher than 100 bar, in particular higher than 110 bar, for example, between 105 and 135 bar.
- The second product pressure (pressurized liquid nitrogen that is heated in the main heat exchanger) is preferably lower than 100 bar, in particular lower than 90 bar, for example, between 30 and 80 bar.
- The second supercritical pressure (upper air pressure level) is preferably lower than the first product pressure and in particular less than 100 bar, in particular less than 90 bar, for example, between 60 and 90 bar.

The first subcritical pressure of the first air feed stream (direct air) is preferably the same as the operating pressure of the high-pressure column plus line losses. The first subcritical pressure generally lies, for example, between 5.0 and 6.0 bar, preferably between 5.3 and 5.7 bar.

A third air feed stream can—optionally after secondary compression to a third pressure, which lies between the first subcritical and second supercritical pressures—subjected to work-expansion in a gaseous state in an air turbine in order to generate cold conditions for the method; the inlet temperature of the air turbine is then at an intermediate level between the hot and cold ends of the main exchanger. As an alternative or in addition, a portion of the air compressed to the second, supercritical pressure is work-expanded from an intermediate temperature.

Preferably, with the method, all of the air is compressed to the first, subcritical pressure, precooled and purified at this pressure, and then divided into the first and second charging air streams. In principle, however, a completely separate compression of the first and second charging air streams is also possible.

BRIEF DESCRIPTION OF THE DRAWINGS

The inventive process and apparatus, as well as further aspects of the invention, are explained in more detail below based on an embodiment which is diagrammatically depicted in the FIGURE.

All of the air is compressed in a main air compressor to a "first, subcritical pressure" of 6 bar and then precooled and purified (not shown). The purified feed air 1 is divided up into a first air feed stream 100, a second air feed stream 200, and a third air feed stream 300.

The first air feed stream 100 is introduced at this first pressure into a main heat exchanger 2, and it completely flows through the latter from the hot to the cold end. The first air feed stream 101, cooled to approximately its dew-point temperature, is then introduced via line 3 into the high-pressure column 4 of a distillation-column system, which in addition has a low-pressure column 5 and a main condenser 6. The two columns, as depicted, are arranged above one another as a standard double column arrangement; as an alternative, they could stand beside one another. Generally, the operating pressure of the high-pressure column is around 4.9 to 7.0 bars, preferably 5.3 to 6.1 bars, and the general operating pressure of the low-pressure column is around 1.1 to 2.3 bars, preferably 1.2 to 1.4 bars The second air feed stream 200 is compressed in a first secondary compressor 7, cooled in a first secondary condenser 8, further compressed in a second secondary compressor 9 to a second, supercritical pressure of 85 bar, and then cooled a second secondary condenser 10. Thereafter, the second air feed stream 200 is divided at 201 into a first partial stream 210 and a second partial stream 202. The first partial stream 210/211 of the second air feed stream 200 also completely flows through the main heat exchanger 2 from the hot end up to the cold end. The second partial stream 220/221 of the second air feed stream does not flow through the main heat exchanger 2 at all. The latter is cooled completely in a high-pressure heat-exchanger system, which is formed in the embodiment from two helically-wound heat exchangers 11, 12, which are arranged in separate shells.

At 204, the three partial streams (the third partial stream is described below) of the second air feed stream are recombined and then work-expanded in a liquid turbine 13 to the operating pressure of the high-pressure column (approximately 6 bar). The liquid turbine is braked by a generator 14. The resultant work-expanded second air feed stream 205 is introduced into the high-pressure column 4 in a predominantly liquid state.

A third partial stream 230 of the second air feed stream 200 is cooled to an intermediate temperature of 165 K together with the second partial stream 220 in the hot helically-wound heat exchanger 11, and then removed from helically-wound heat exchanger 11 via line 203. At 206, the third partial stream 230 is split off (branched off) from the second partial stream 220, and the third partial stream 230 is then fed to the main heat exchanger 2 at an intermediate point that corresponds to its temperature. The third partial stream 230 is ultimately cooled in the main heat exchanger 2 up to the cold end thereof. The completely cooled third partial stream 231 removed from the cold end of the main heat exchanger 2 is combined at 204 with the remainder of the second air feed stream (i.e., the first and second partial streams).

Together with the second air feed stream 200, a third air feed stream 300 is further compressed to a third pressure of, for example, 49 to 61 bars, preferably 53 to 57 bars, e.g., 55 bar, in the secondary compressor 7 and at this pressure enters into the hot end of the main heat exchanger 2. At a temperature that is somewhat higher than the intermediate temperature of the third partial stream 230 of the second air feed stream, the third air feed stream 301 is removed from the main heat exchanger 2 and work-expanded in an air turbine 15 to approximately the operating pressure of the high-pressure column 4. The air turbine 15 drives the second secondary compressor 9. The resultant turbine-depressurized third air feed stream 303 is introduced in gaseous form into the high-pressure column 4 via line 3.

A liquid oxygen stream 16 from the low-pressure column 5 is brought in an oxygen pump 17 in the liquid state to a first product pressure that is approximately 115 bar, in this exemplary embodiment. The liquid oxygen stream 16 is heated at this first product pressure to approximately ambient temperature in the high-pressure heat-exchanger system 12/11, and is ultimately recovered as a high-pressure oxygen product stream 18. The oxygen flows through the interior of the helically-wound pipes of the heat exchangers 11 and 12, and the second air feed stream 202 or 206 flows through the shell thereof.

A liquid nitrogen stream 19 removed from the high-pressure column 4 (it could also be removed from the main condenser 6) is brought in the liquid state to a second product pressure in a nitrogen pump 20 (this second product pressure is approximately 80 bar in this exemplary embodiment). The pressurized liquid nitrogen stream is then heated at this second product pressure to approximately ambient temperature, and is ultimately recovered as a high-pressure nitrogen product stream 21.

In addition, the following gas streams are heated in the main heat exchanger 2:

- a low pressure gaseous pure nitrogen 22/23 removed from the top of the low-pressure column 5,
- a low pressure gaseous impure nitrogen 24/25 removed from an intermediate point of the low-pressure column 5, and
- pressurized gaseous nitrogen 26/27 removed from the top of the high-pressure column 4.

A portion of the low-pressure nitrogen 23, 25 can be used for regeneration of the purification unit for the charging air (not shown). The heated pressurized gaseous nitrogen can be used as seal gas 28 and/or as a medium-pressure product 29.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding European patent application No. 13000875.8, filed Feb. 21, 2013, are incorporated by reference herein.

The invention claimed is:

1. A method for recovering high-pressure oxygen and high-pressure nitrogen by low-temperature separation of air in a distillation-column system comprising a high-pressure column (4) and a low-pressure column (5), which are in heat-exchange connection via a main condenser (6) which is a condenser-evaporator, said method comprising:

Cooling a first air feed stream (100, 101) at a first, subcritical, pressure, which is less than 1 bar above the operating pressure of said high-pressure column (4), in a main heat exchanger (2), and introducing (3) the cooled first air feed stream into said high-pressure column (4), Cooling a second air feed stream (200) at a second, supercritical, pressure, and subsequently depressurizing and introducing the cooled second air feed stream into said distillation-column system, Pressurizing (17) a liquid oxygen stream (16) from said low-pressure column (5), in the liquid state, to a first product pressure which is higher than the operating pressure of said low-pressure column, heating said liquid oxygen stream (16) at the first product pressure in a heat-exchanger system (11, 12) having at least two helically-wound heat exchangers connected in series, and ultimately recovering as a high-pressure oxygen product stream (18), Pressurizing (20) a liquid nitrogen stream (19) from said high-pressure column (4) or from said main condenser (6), in the liquid state, to a second product pressure which is higher than the operating pressure of said high-pressure column (4), heating said liquid nitrogen stream (19) at the second product pressure to approximately ambient temperature, and ultimately recovering as a high-pressure nitrogen product stream (21), Cooling a first partial stream (210) of said second air feed stream (200) by indirect heat exchange in said main heat exchanger (2), Cooling a second partial stream (202, 221) of said second air feed stream (200) in said heat-exchanger system (11, 12), Merging said first partial stream (211) and said second partial stream (221) of the second air feed stream downstream from their cooling to form a merged second air feed stream, Wherein the heating of the liquid nitrogen stream (19) that is pressurized in liquid form is performed in said main heat exchanger (2) by indirect heat exchange with said first air feed stream (100) and said first partial stream (210) of said second air feed stream (200), Wherein said merged second air feed stream is depressurized in a liquid turbine (13) before said merged second air feed stream is introduced (205, 3) into said distribution-column system, a third partial stream (230) of said second air feed stream (200), cooled to an intermediate temperature in said heat-exchanger system, is branched off from the second partial stream (206) of said second air feed stream between the two helically-wound heat exchangers (11, 12) of said heat-exchanger system, and introduced into the main heat exchanger (2) at an intermediate point and further cooled therein, and after said third partial stream (230) is branched off from said second partial stream, the remainder of the second partial stream (206) of the second air feed stream is further cooled in said heat-exchanger system (12), said method further comprising cooling a third air feed stream (300) at a third pressure which is above said first, subcritical, pressure and below said second, supercritical, pressure, in said main heat exchanger (2), removing the cooled third air feed stream from said main heat exchanger at an intermediate point, expanding the cooled third air feed stream, and introducing the cooled and expanded third air feed stream into said high-pressure column (4), and wherein the entirety of said cooled first air feed stream, said cooled second air feed stream, and said cooled and expanded third air feed stream are introduced into said high-pressure column (4).

2. The method according to claim 1, wherein said third partial stream (231) is merged with said first partial stream (211) and said second partial stream (221) downstream of said main heat exchanger (2) and upstream from said liquid turbine (13).

3. The method according to claim 1, wherein the first product pressure is higher than 100 bar.

4. The method according to claim 3, wherein the first product pressure is higher than 110 bar.

5. The method according to claim 3, wherein the first product pressure is between 105 and 135 bar.

6. The method according to claim 1, wherein the second product pressure is lower than 100 bar.

7. The method according to claim 6, wherein the second product pressure is lower than 90 bar.

8. The method according to claim 7, wherein the second product pressure is between 30 and 80 bar.

9. The method according to claim 1, wherein the second, supercritical pressure is lower than the first product pressure.

10. The method according to claim 9, wherein the second, supercritical pressure is less than 100 bar.

11. The method according to claim 10, wherein the second, supercritical pressure is less than 90 bar.

12. The method according to claim 10, wherein the second, supercritical pressure is between 60 and 90 bar.

13. The method according to claim 1, wherein first subcritical pressure is between 5.0 and 6.0 bar.

14. The method according to claim 13, wherein first subcritical pressure is between 5.3 and 5.7 bar.

15. The method according to claim 1, wherein said third partial is introduced into the main heat exchanger at a temperature of between 220 and 120 K.

16. The method according to claim 15, wherein said third partial is introduced into the main heat exchanger at a temperature of between 190 and 150 K.

17. The method according to claim 1, wherein the intermediate point at which said third partial stream (231) is introduced into said main heat exchanger (2) is closer to the cold end of said main heat exchanger (2) than the intermediate point at which said cooled third air feed stream is removed from said main heat exchanger (2).

18. The method according to claim 1, wherein said third pressure of said third air feed stream (300) is 53 to 61 bars.

19. The method according to claim 1, wherein said cooled third air feed stream (300) is removed from said main heat exchanger at temperature that is higher than the intermediate temperature of the third partial stream (230) of the second air feed stream.

20. The method according to claim 1, wherein the following gas streams are heated in said main heat exchanger:

a low pressure gaseous pure nitrogen (22, 23) removed from the top of said low-pressure column (5), a low pressure gaseous impure nitrogen (24, 25) removed from an intermediate point of said low-pressure column (5), and gaseous nitrogen (26, 27) removed from the top of said high-pressure column (4).

* * * * *